US009108327B1

(12) United States Patent
Brooks

(10) Patent No.: US 9,108,327 B1
(45) Date of Patent: Aug. 18, 2015

(54) HAIR TRIMMER WITH LEVEL INDICATOR

(71) Applicant: James H. Brooks, Kawkawlin, MI (US)

(72) Inventor: James H. Brooks, Kawkawlin, MI (US)

( * ) Notice: Subject to any disclaimer, the term of this patent is extended or adjusted under 35 U.S.C. 154(b) by 225 days.

(21) Appl. No.: 13/866,170

(22) Filed: Apr. 19, 2013

(51) Int. Cl.
*B26B 19/38* (2006.01)
*B26B 21/40* (2006.01)

(52) U.S. Cl.
CPC ..... *B26B 19/388* (2013.01); *B26B 21/4056* (2013.01)

(58) Field of Classification Search
CPC ..... B26B 21/4056; B26B 19/388
USPC ..... 33/334
See application file for complete search history.

(56) References Cited

U.S. PATENT DOCUMENTS

| | | | | |
|---|---|---|---|---|
| 2,879,777 | A * | 3/1959 | Miller | 132/213.1 |
| 3,121,286 | A * | 2/1964 | Schneiderman | 30/34.05 |
| 3,885,306 | A * | 5/1975 | Herman | 30/123 |
| 4,215,474 | A | 8/1980 | Kelley | |
| 4,368,745 | A * | 1/1983 | McGuffey | 132/213.1 |
| 4,428,124 | A * | 1/1984 | Asakura | 33/334 |
| D306,917 | S | 3/1990 | Terasawa et al. | |
| 5,488,779 | A * | 2/1996 | Schultheis et al. | 33/366.27 |
| 6,125,857 | A * | 10/2000 | Silber | 132/215 |
| 6,233,535 | B1 * | 5/2001 | Petretty | 702/187 |
| 7,975,387 | B2 | 7/2011 | Mikula et al. | |
| 2005/0011531 | A1 * | 1/2005 | Gers | 132/213.1 |
| 2008/0222906 | A1 * | 9/2008 | Austin | 33/334 |
| 2012/0227554 | A1 * | 9/2012 | Beech | 83/13 |
| 2013/0298406 | A1 * | 11/2013 | Chen et al. | 30/34.05 |
| 2014/0137714 | A1 * | 5/2014 | Krenik | 83/23 |

* cited by examiner

*Primary Examiner* — Christopher Fulton
(74) *Attorney, Agent, or Firm* — Crossley Patent Law

(57) ABSTRACT

A hair trimmer with level indicator that includes a level sensor disposed in circuit with a pair of Light Emitting Diodes, a buzzer, a speaker, and a Central Processing Unit, wherein each of said pair of Light Emitting Diodes is configured to illuminate, and the buzzer is configured to sound, to signal to a user that the hair trimmer with level indicator is levelly oriented and a straight cut to a hairline may presently be effected.

8 Claims, 3 Drawing Sheets

HAIR TRIMMER WITH LEVEL INDICATOR

BACKGROUND OF THE INVENTION

Various types of hair trimmers are known in the prior art. However, what is needed is a hair trimmer with level indicator that includes a level sensor disposed in circuit with a pair of Light Emitting Diodes, a buzzer, a speaker, and a Central Processing Unit, wherein each of said pair of Light Emitting Diodes is configured to illuminate to signal to a user that the hair trimmer with level indicator is levelly oriented and a straight cut to a hairline may therefore be effected.

FIELD OF THE INVENTION

The present invention relates to a hair trimmer with level indicator, and more particularly, to a hair trimmer with level indicator that includes a level sensor disposed in circuit with a pair of Light Emitting Diodes, a buzzer, a speaker, and a Central Processing Unit, wherein each of said pair of Light Emitting Diodes is configured to illuminate to signal to a user that the hair trimmer with level indicator is levelly oriented and a straight cut to a hairline may therefore be effected.

SUMMARY OF THE INVENTION

The general purpose of the hair trimmer with level indicator, described subsequently in greater detail, is to provide a hair trimmer with level indicator which has many novel features that result in a hair trimmer with level indicator which is not anticipated, rendered obvious, suggested, or even implied by prior art, either alone or in combination thereof.

The present hair trimmer with level sensor has been devised to enable means to indicate a level orientation of said trimmer whereby straight and level cuts are afforded by a person wielding the device. Trimming hairlines, around the nape, sideburns, or facial hair, as case may be, requires an amount of precision to avoid unwanted corrective measures required to balance an unlevel cut, which may inadvertently, substantially alter a person's desired appearance.

The present device includes a level sensor disposed in circuit with each of a pair of Light Emitting Diodes ("LEDs"). Each of the pair of LEDs is disposed upon respective sides of the trimmer, there configured to illuminate when the present hair trimmer is oriented with the trimming blades horizontally disposed relative the ground. This level orientation is signaled when both of the pair of LEDs illuminate a constant light.

The present hair trimmer with level sensor also includes a speaker wired in circuit with a buzzer. The buzzer is configured to sound when the device is level and, alternately, to signal a tilt and warn a user of the device to re-level the device before continuing use. It is contemplated that the buzzer may be deactivated, as desired.

A Central Processing Unit ("CPU") is disposed in circuit within the device to operationally control the illumination of the pair of LEDs and sound the buzzer when the level sensor senses the level orientation of the trimmer whereby a user is alerted to the horizontal orientation of the device.

A control button is disposed upon the trimmer which, when depressed, activates the level sensor, the LEDs, and buzzer. Thus, when a user wishes to be alerted whenever the present device is level, said user may, at the touch of the control button, activate the level sensor and each of the pair of LEDs and the buzzer, if desired, whereby the level orientation of the trimmer is signaled by illumination of the LEDs and the sounding of the buzzer (when not disabled).

It is further contemplated that each of the pair of LEDs may illuminate to signal tilt of the device. Thus, a flashing one of the pair of LEDs may signal, for example, that the device needs to be reoriented in a direction signaled by said flashing LED until, for example, both LEDs illuminate a constant light whereby the level orientation of the device is signaled as attained. The frequency of the flashing of each respective LED, when signaling tilt, may increase as the tilt is corrected until the constant illumination of both LEDs signaling a level orientation is effected.

It is also contemplated that the buzzer may be set to sound to warn of tilt, and immediately alert a user that the device is no longer level and that, before continued trimming of a particular hairline, the device should be leveled once more.

Thus has been broadly outlined the more important features of the present hair trimmer with level indicator so that the detailed description thereof that follows may be better understood and in order that the present contribution to the art may be better appreciated.

Objects of the present hair trimmer with level indicator, along with various novel features that characterize the invention are particularly pointed out in the claims forming a part of this disclosure. For better understanding of the hair trimmer with level indicator, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
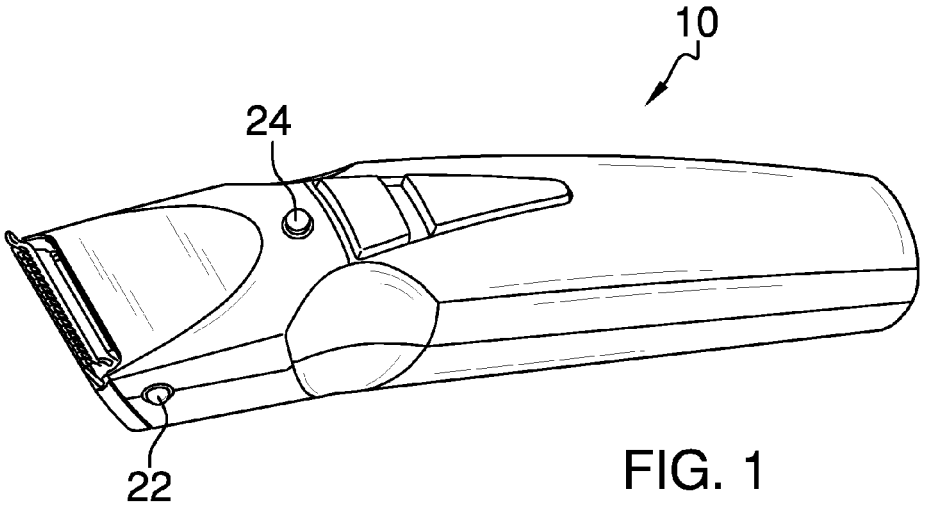
FIG. 1 is an isometric view.

With reference now to the drawings, and in particular FIGS. 1 through 5 thereof, example of the instant hair trimmer with level indicator employing the principles and concepts of the present hair trimmer with level indicator and generally designated by the reference number 10 will be described.

Referring to FIGS. 1 through 5 a preferred embodiment of the present hair trimmer with level indicator 10 is illustrated.

The present hair trimmer with level indicator 10 has been devised to enable means to indicate to a user when said hair trimmer 10 is oriented horizontally and levelly to ensure a straight cut is executed. Mistakes trimming hair can have lasting effects and necessitate corrective measures which may conflict with a person's desired appearance. Hair stylists, barbers, beauty specialists, and others could be advantaged by such a device that indicates a level orientation and affords a straight cut to prevent unevenness, angled lines, or other uneven results of applying a hair trimmer unevenly to a hairline.

The present hair trimmer with level indicator 10, therefore, includes a level sensor 20 disposed to sense the orientation of the trimmer 10 in space. The device 10 is configured to illuminate each of a pair of Light Emitting Diodes ("LEDs") 22, disposed on either side of the trimmer 10, when the trimmer 10 is disposed in a level orientation. Thus a barber, or other person wielding the device 10 as case may be, is alerted to the level orientation before applying a cut to a hairline. As long as the device 10 is maintained in a level orientation, each of the pair of LEDs 22 illuminate.

A control button 24, disposed atop the hair trimmer with level indicator 10, is usable to operationally activate the pair of LEDs 22. When the control button 24 is depressed, the level sensor 20 is activated and each of the pair of LEDs 22 will thence illuminate when the level sensor 20 senses a level orientation of the device 10.

Figure 2:
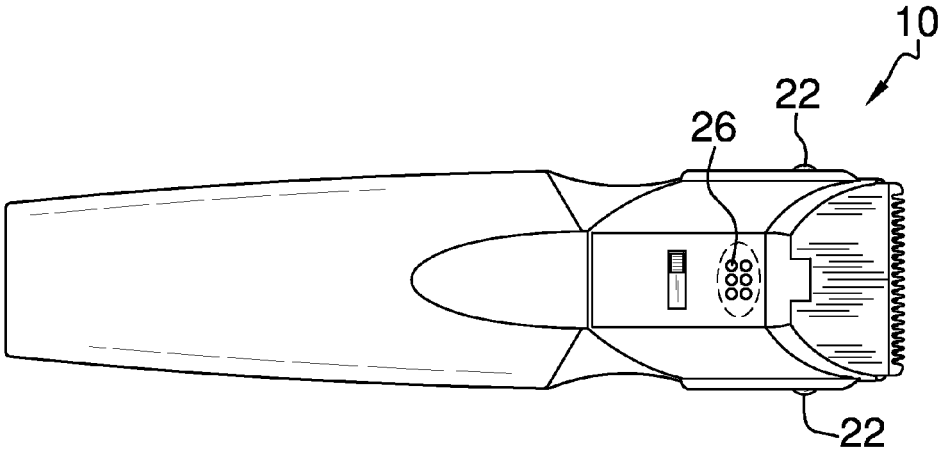
FIG. 2 is a bottom view.
Figure 3:
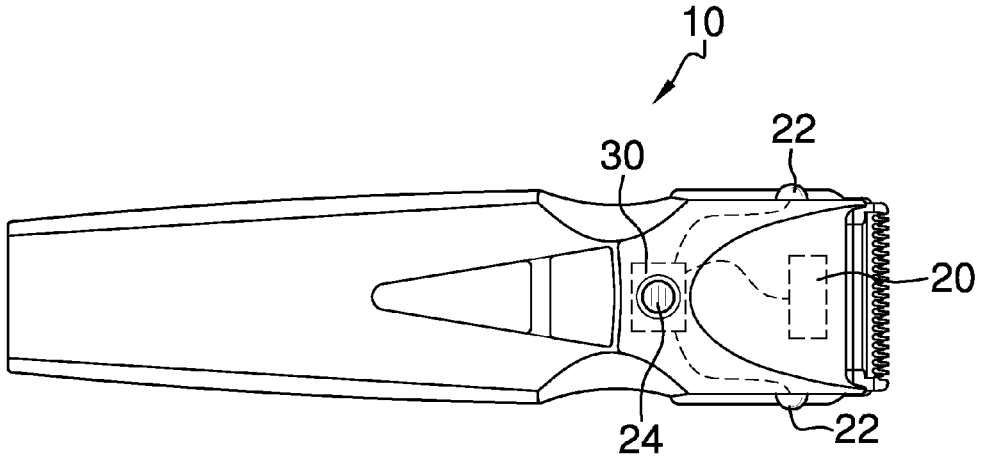
FIG. 3 is a top view.
Figure 4:
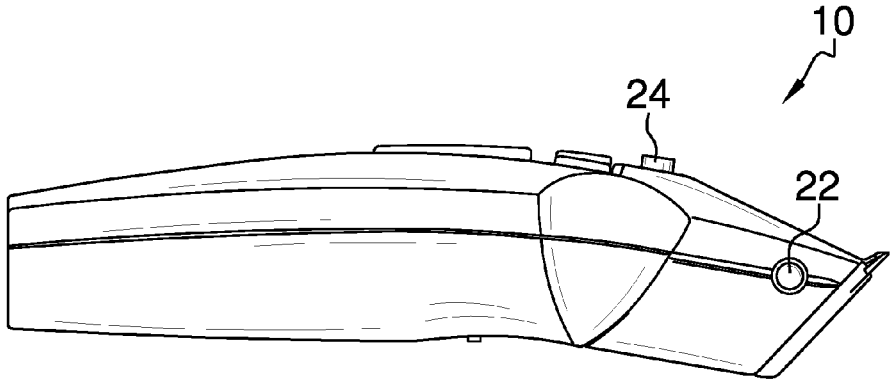
FIG. 4 is a side view.
Figure 5:
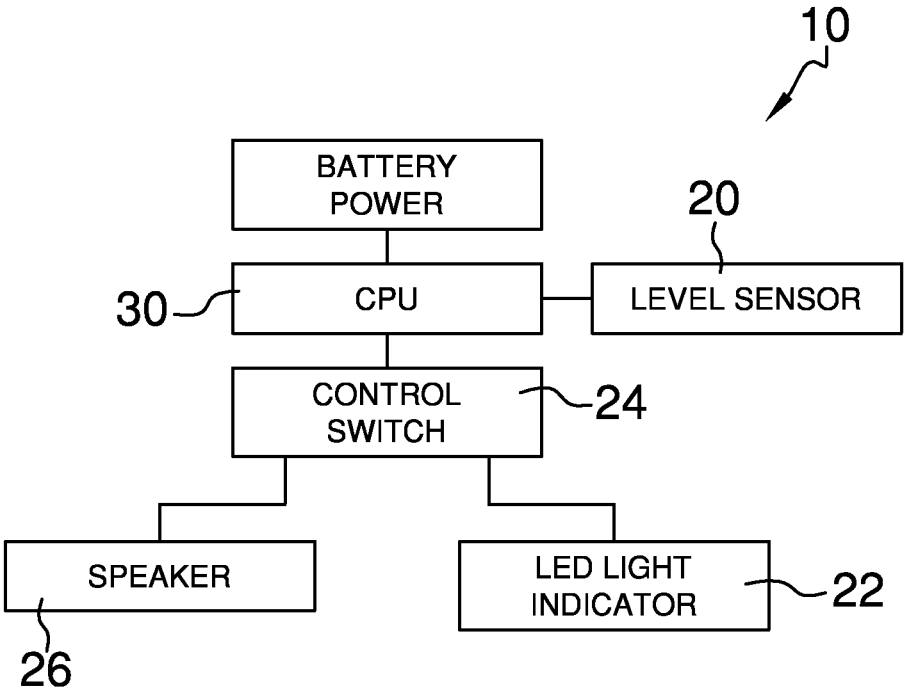
FIG. 5 is a block diagram.

As best shown in FIGS. 2 and 3, the present hair trimmer with level indicator 10 also includes a speaker 26 medially disposed upon the trimmer 10 proximal the level sensor 20 and the pair of LEDs 22. A buzzer 28, in circuit with the speaker 26, may be optionally enabled to sound and thereby indicate a level orientation, or to warn against tilt. It is contemplated that the buzzer 28 may be deactivated, as desired.

A Central Processing Unit ("CPU") 30, disposed within the present hair trimmer with level indicator 10, is in operational communication in circuit with the level sensor 20, the pair of LEDs 22, the buzzer 28, and the speaker 26, and thus controls the illumination of the pair of LEDs 22 and the sounding of the buzzer 28, as desired, when the control button 24 is depressed to activate the level sensor 20.

The illumination of the pair of LEDs 22 is contemplated to respond to different orientations of the device 10. For example, one of the pair of LEDs 22 may flash intermittently to signal that the trimmer needs adjustment in a particular direction before the device 10 is level. The frequency of this flashing of a respective one of the pair of LEDs 22 is contemplated to be variable, increasing until both LEDs 22 illuminate a constant light and signal a level orientation of the device 10. Moreover, it is contemplated that the buzzer 28 may sound to warn against tilt, and alert a user that the device 10 has lost a level orientation which should be restored before continuing use.

What is claimed is:

1. A hair trimmer with level indicator comprising:

a level sensor;

a pair of Light Emitting Diodes disposed on either side of the hair trimmer, each of said Light Emitting Diodes illuminable to indicate a level orientation of said trimmer;

a control button disposed upon the trimmer, said control button configured to activate the level sensor;

a Central Processing Unit disposed within the trimmer in operational communication between the level sensor and each of the pair of Light Emitting Diodes;

wherein depressing the control button activates each of the pair of Light Emitting Diodes to illuminate when the hair trimmer with level indicator is sensed to be in a level orientation whereby a straight and level cut is afforded; and a speaker medially disposed upon the trimmer proximal the level sensor and the pair of Light Emitting Diodes, said speaker disposed in circuit with a buzzer wherein the buzzer is sounded to indicate a level orientation of the trimmer when the control button is depressed and the level sensor is activated.

2. The hair trimmer with level indicator of claim 1 wherein the buzzer is optionally disabled.

3. The hair trimmer with level indicator of claim 2 wherein each of the pair of Light Emitting Diodes illuminates intermittently when the device is tilted to signal the need of leveling the device by lowering the respective side of the device whereon a particular one of the pair of Light Emitting Diodes is intermittently illuminating.

4. The hair trimmer with level indicator of claim 3 wherein the frequency of said intermittent illumination increases as the device approaches a level orientation whereby both Light Emitting Diodes thence illuminate a constant light when the device is sensed to be in a level orientation.

5. A hair trimmer with level indicator comprising:

a level sensor;

a pair of Light Emitting Diodes disposed on either side of the hair trimmer, each of said Light Emitting Diodes illuminable to indicate a level orientation of said trimmer;

a control button disposed upon the trimmer, said control button configured to activate the level sensor and each of the pair of Light Emitting Diodes;

a speaker medially disposed upon the trimmer proximal the level sensor and the pair of Light Emitting Diodes;

a buzzer disposed in circuit with the speaker;

a Central Processing Unit disposed within the trimmer in operational communication between the level sensor, the buzzer, the speaker, and each of the pair of Light Emitting Diodes;

wherein depressing the control button illuminates each of the pair of Light Emitting Diodes and sounds the buzzer to signal the hair trimmer with level indicator is leveled whereby a straight and level cut is afforded.

6. The hair trimmer with level indicator of claim 5 wherein the buzzer is optionally disabled during use, as desired.

7. The hair trimmer with level indicator of claim 6 wherein each of the pair of Light Emitting Diodes illuminates intermittently when the device is tilted to signal the need of leveling the device by lowering the respective side of the particular Light Emitting Diode that is intermittently illuminating.

8. The hair trimmer with level indicator of claim 7 wherein the frequency of said intermittent illumination increases as the device approaches a level orientation whereby both Light Emitting Diodes then illuminate a constant light when the device is sensed to be in a level orientation.

* * * * *